US005181881A

United States Patent [19]

Abe

[11] Patent Number: 5,181,881

[45] Date of Patent: Jan. 26, 1993

[54] OUTLET DEVICE FOR COIN PAYOUT HOPPERS

[75] Inventor: Hiroshi Abe, Tokyo, Japan

[73] Assignee: Asahi Seiko Kabushiki Kaisha, Tokyo, Japan

[21] Appl. No.: 789,963

[22] Filed: Nov. 12, 1991

[30] Foreign Application Priority Data

Nov. 15, 1990 [JP] Japan ..... 2-307192

[51] Int. Cl.[5] ..... G07D 1/00

[52] U.S. Cl. ..... 453/57; 194/344; 221/267

[58] Field of Search ..... 453/30, 32, 49, 50, 453/51, 52, 57; 221/267, 307, 310; 193/DIG. 1, 35 B, 37

[56] References Cited

U.S. PATENT DOCUMENTS

| | | | |
|---|---|---|---|
| 3,460,661 | 8/1969 | Albright et al. | 194/344 X |
| 3,837,454 | 9/1974 | Joeck | 194/344 X |
| 4,518,001 | 5/1985 | Branham | 221/267 X |
| 4,923,430 | 5/1990 | Iimura | 221/307 X |
| 4,943,258 | 7/1990 | Abe | 453/30 |

FOREIGN PATENT DOCUMENTS

| | | |
|---|---|---|
| 62-45588 | 9/1987 | Japan . |
| 3-66466 | 6/1991 | Japan . |

*Primary Examiner*—F. J. Bartuska

*Attorney, Agent, or Firm*—Nilles & Nilles

[57] ABSTRACT

An outlet device for a coin payout hopper including an outlet chute having a curved outlet chute passage for upwardly pushing coins out of an upper outlet by trailing coins pushed into a lower inlet in the horizontal direction from the coin payout hopper. The outlet chute includes an outside edge plate having an outside coin guide track positioned at the outside with respect to the center of the radius of curvature of the curved outlet chute passage with the outside coin guide track being inclined to an acute angle to a coin supporting surface of a coin supporting back plate and an inside edge plate having an inside coin guide track positioned at the inside with respect to the center of the radius of curvature of the curved outlet chute passage. The inside edge plate is covered at the lower inlet portion thereof with a flexible front plate such that a portion of the flexible front plate is extended beyond the inside coin guide track to engage outer peripheral portions of coins, thereby preventing the curved outlet chute passage from jamming by a deformed coin. Furthermore, at least one rotatable tapered guide roller having an inverted conical surface is provided at the upper outlet portion adjacent to the inside edge plate and is urged to engage the outer periphery of the coin, thereby preventing the coin from rising above the coin supporting surface of the back plate.

5 Claims, 4 Drawing Sheets

OUTLET DEVICE FOR COIN PAYOUT HOPPERS

BACKGROUND OF THE INVENTION

1. Field of the Invention:

The present invention relates to an outlet device for coin payout hoppers used in vending machines, game machines, coin exchangers or the like, in particular to an outlet chute adapted for guiding coins to a vertically extending escalator out of the coin payout hoppers.

2. Related Art Statement:

Hitherto, there is a coin payout hopper as described in Japanese Patent Application Publication No. 62-45,588 comprising a hopper for storing coins, a rotary disc rotatably mounted on a supporting plate inclined at an angle to the horizontal within said hopper, a plurality of delivery pins spaced in the peripheral direction of the rotary disc and a delivery knife for guiding coins at an upper delivery portion to a discharge chute.

Some coin payout hoppers of the type mentioned above are provided with an outlet device which comprises an outlet chute for receiving coins discharged from the coin payout hopper, and an escalator which is connected at the lower end thereof to an upper outlet of the outlet chute and upwardly extended from the upper outlet for transferring coins to an upper coin tray by pushing up each coin in the escalator by the following coins pushed into the outlet chute out of the coin payout hopper.

In the conventional outlet chute 1 of such an outlet device, as shown in FIG. 1, coins 2 are pushed out of a payout hopper into a lower inlet 3 of an arciform curved outlet chute passage 4 in the horizontal direction as shown by an arrow A and pushed up from an upper outlet 5 into a vertically extending escalator passage 7 of an escalator 6 connected to the upper outlet 5 of the outlet chute 1.

The conventional curved outlet chute passage 4, as shown in FIG. 2 is composed of a coin supporting back plate 8, outside and inside edge plate 11 and 12, which are positioned at the outside and inside with respect to the center of the radius of curvature of the curved outlet chute passage 4, respectively, and outside and inside front plates 15 and 16 which are rigidly secured to the back plate 8 together with the edge plates 11 and 12 by means of screws 13 and 14, respectively and have extensions 15*a* and 16*a* beyond the coin guiding tracks 9 and 10 of the edge plates 11 and 12 respectively, to engage outer peripheral portions of the coins to guide the coins in the curved outlet chute passage 4 and to prevent the coins from dropping out of the passage.

Such a conventional outlet device as mentioned above has drawbacks such that if a deformed coin is pushed in the guiding passage by a trailing coin, the front end of the deformed coin may be pushed over the rear end of the preceding coin or the trailing coin may be pushed into the under side of the rear end of the deformed coin whereby jamming the guiding passage, and even if upward movement of a normal coin is resisted by weight of a number of preceding coins to cause the rear end of the normal coin to be spaced from the back plate, the front end of the trailing coin may be pushed into the under side of the rear end of the normal coin whereby also jamming the guiding passage so that no coin is delivered from the outlet chute.

SUMMARY OF THE INVENTION

An object of the present invention is to eliminate the drawback mentioned above and to provide an outlet device without jamming in the curved coin guide passage.

According to the present invention, as shown in FIG. 3, an outlet device for a coin payout hopper comprises an outlet chute 1 including a curved outlet chute passage 4 having a lower inlet 3 through which coins are pushed into the passage substantially in the horizontal direction and an upper outlet 5 through which coins are pushed out the passage substantially in the vertical direction, an outside edge plate 11 having an outside coin guide track 9 positioned at the outside with respect to the center of the radius of curvature of the curved outlet chute passage 4 and being fixed to a coin supporting back plate 8 such that the outside coin guide track 9 is inclined at an angle to the surface of the coin supporting back plate 8, an inside edge plate 12 having an inside coin guide track 10 positioned at the inside with respect to the center of the radius of curvature of the curved outlet chute passage 4 and being covered at the lower inlet portion thereof with a flexible front plate 20 such that a portion of the flexible front plate 20 is extended beyond the inside coin guide track 10 to engage outer peripheral portions of coins, and at least one rotatable tapered guide roller 22 having an inverted conical surface 22*a* provided at the upper outlet portions adjacent to the inside edge plate for engaging the outer periphery of the coin to urge the coin to the surface of the coin supporting back plate.

The tapered guide roller 22 is rotatably supported on a roller shaft which is substantially perpendicularly extended through the coin supporting back plate 8 and resiliently urged by means of a spring 18 or 26 so as to engage the outer periphery of the coin pushed out of the outlet chute passage 4.

With the aforementioned arrangement of the present invention, coins 2 are pushed into the lower inlet 3 of the outlet chute 1 in substantially the horizontal direction by means of the coin payout hopper and pushed in the curved outlet chute passage 4 toward the upper outlet 5 in the vertical direction by trailing coins as shown in FIG. 4. Thus, coins 2 are urged to the outside guide track 9 positioned at the outside with respect to the center of the radius of curvature of the curved outlet chute passage 4 to forcedly progress along the outside guide track 9 in the curved outlet chute passage 4 which is defined by the coin supporting back plate 8, the outside guide track 9, the inside guide track 10 and the portion of the flexible front plate extended beyond the inside guide track 10. If a deformed coin enters in the curved outlet chute passage 4, the leading end of the deformed coin 2*a* rides on the trailing end of the leading coin 2 and as the result the flexible front plate 20 is resiliently deformed to open the outlet chute passage as shown in FIG. 6.

Thus, the deformed coin 2*a* is completely pushed out of the outlet chute passage 4 by the trailing coin 2 and removed from the outlet chute.

On the other hand, the normal coin 2 is pushed up in the outlet chute passage 4 covered with the flexible front plate 20 by the trailing coin and between the outside guide track 9 and the tapered roller 22 against the spring force of the spring 18. The inclined surface of the outside guide track 9 and the inverted conical surface 22*a* of the tapered guide roller 22 loaded by the spring engage the outer periphery of the coin to urge the coin to the surface of the coin supporting back plate 8 and guide the coin into the outlet escalator.

Thus, the outlet device according to the present invention satisfactly prevent the coin jamming in the outlet chute by the cooperation of the flexible front plate, the inclined outside guide track and the tapered roll arranged in the outlet chute passage for removing the deformed coin and preventing the normal coin from rising above the surface of the supporting back plate.

DESCRIPTION OF THE PREFERRED EMBODIMENTS

Figure 1:
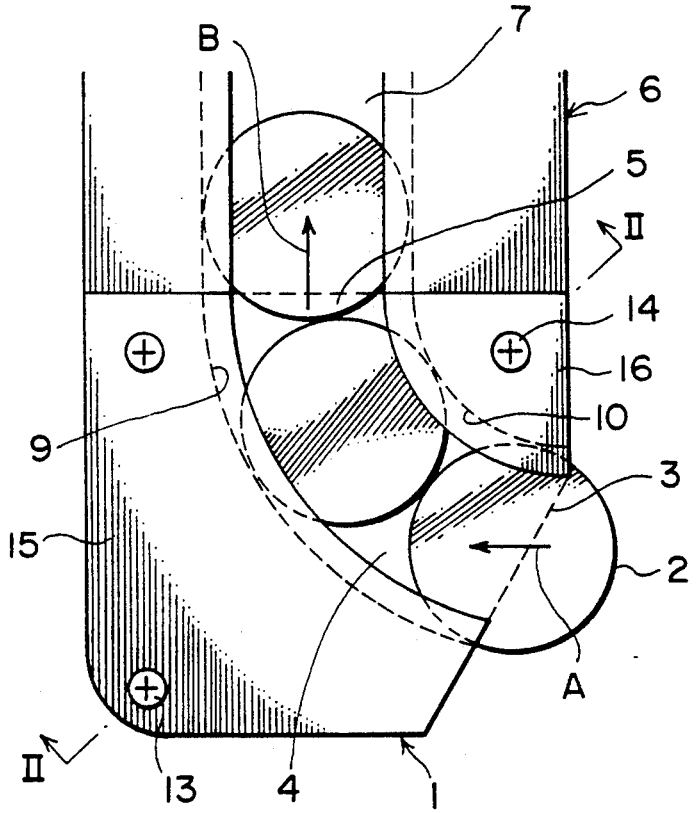
F I G . 1 PRIOR ART
FIG. 1 is an elevational view of an outlet chute of the prior art.
Figure 2:
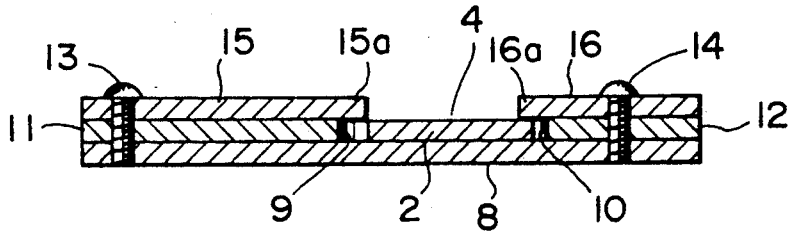
F I G . 2 PRIOR ART
FIG. 2 is a sectional view taken along the line II—II in FIG. 1.
Figure 3:
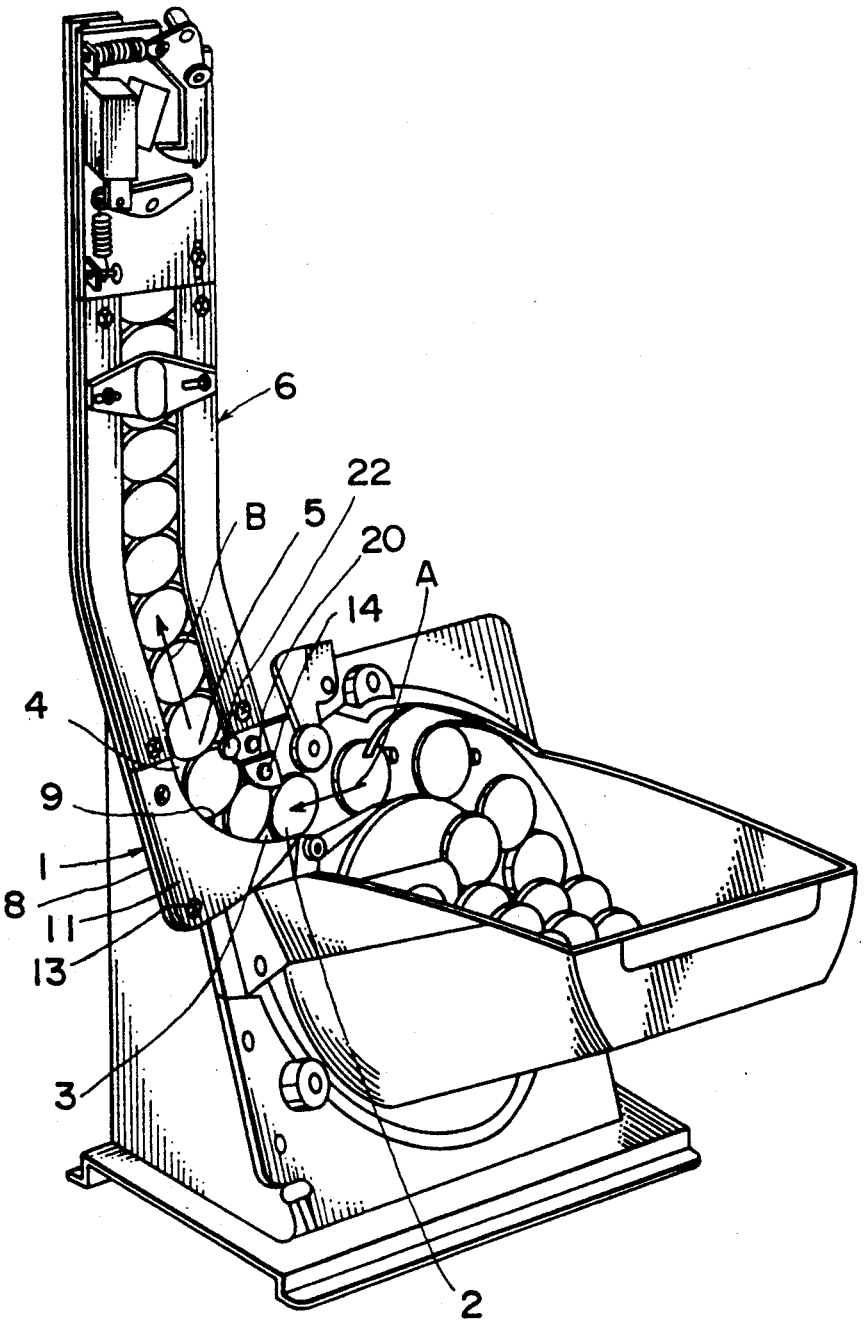
FIG. 3 is a schematic perspective view illustrating a coin payout hopper provided with an outlet chute according to the present invention.

The invention will be described in more detail in the following with reference to the accompanying drawings.

Referring to FIGS. 4–7 illustrating one embodiment of the present invention, an outlet chute 1 includes a lower inlet 3 through which coins 2 are pushed into a curved outlet chute passage 4 in the horizontal direction as shown by an arrow A from a coin payout hopper. These coins 2 are driven in the curved outlet chute passage 4 toward an upper outlet 5 upwardly and pushed out of the upper outlet 5 into an outlet escalator 6 which is substantially vertically extended from the upper outlet 5.

Figure 4:
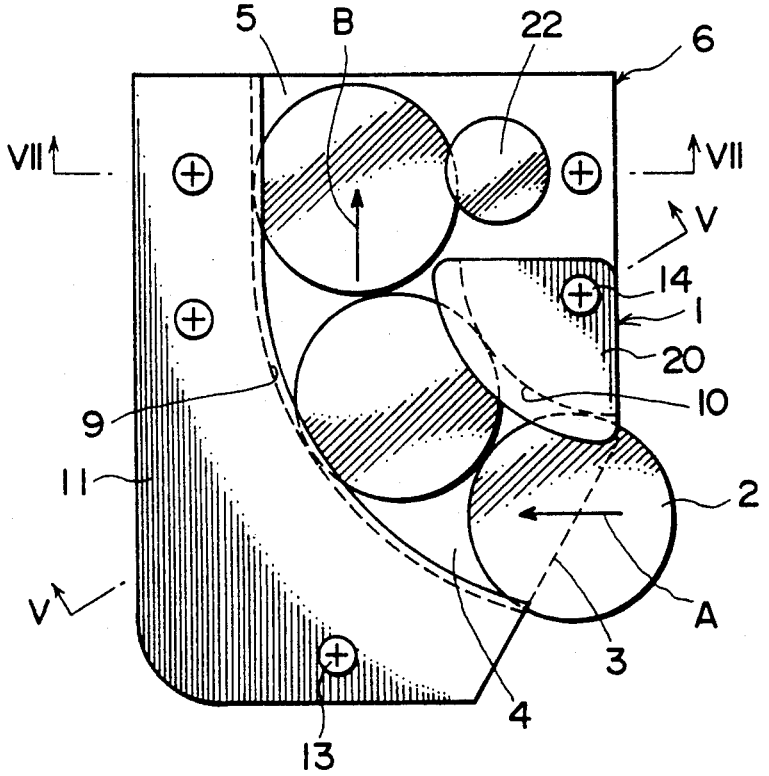
FIG. 4 is an enlarged elevational view of the outlet chute in the coin payout hopper shown in FIG. 3.

Referring to FIG. 4, an outside edge plate 11 having an outside coin guide track 9 positioned at the outside with respect to the center of the radius of curvature of the curved outlet chute passage 4 is fixed to a coin supporting back plate 8 by means of screws 13 and an inside edge plate 12 having an inside coin guide track 10 positioned at the inside with respect to the center of the radius of curvature of the curved outlet chute passage 4 is fixed to the coin supporting back plate 8 by means of a screw 14 together with a resiliently flexible retaining front plate 20 of elastomer material such as urethane rubber, which is positioned at the lower inlet portion.

Figure 5:
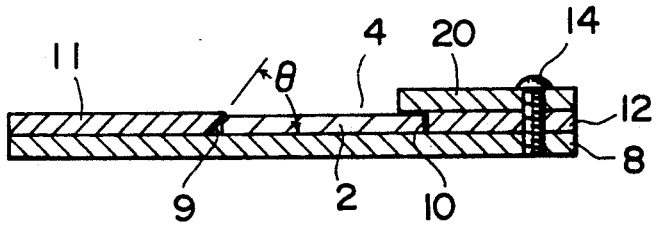
FIG. 5 is a sectional view taken along the line V—V in FIG. 4.
Figure 6:
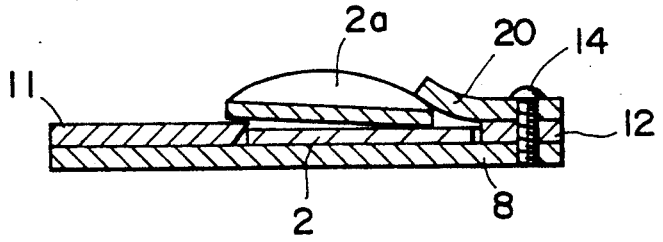
FIG. 6 is a sectional view illustrating the operation of a flexible front plate.

The outer coin guide track 9 may be inclined at an acute angle $\theta$ such as about 70 degrees to the coin supporting back plate 8 (FIG. 5).

The flexible retaining front plate 20 is preferably made of urethane rubber having a hardness in a range of 60°–70° and a thickness in a range of 0.5–2.0 mm.

In this embodiment, a tapered roller 22 is provided at the upper outlet portion of the outlet chute adjacent to the upper end of the inside edge plate 12.

Figure 7:
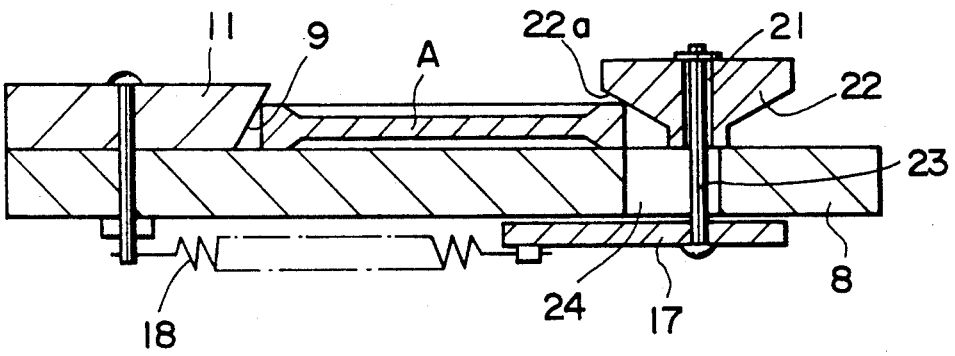
FIG. 7 is an enlarged sectional view along the line VII—VII in FIG. 4.

The tapered guide roller 22 as shown in FIG. 7, has an inverted conical surface **22*a* and a central through hole 21 through which is extended a roller shaft 23 so that the tapered guide roller 22 is rotatably supported on the roller shaft 23**.

The roller shaft 23 is extended through a guide slot 24 formed in the back plate 8 and is secured at the extended end to a slide shoe 17 such that the tapered roller 22 is permitted to move along the back plate 8 in the direction of the width of the outlet chute passage 4. The slide shoe 17 is drawn toward the outside edge plate 11 by means of a tension spring 18.

Thus, a coin A entered between the inclined surface of the outside coin guide track 9 of the outside edge plate 11 and the inverted coincal surface **22*a* of the tapered guide roller 22, as shown in FIG. 7, is engaged the periphery thereof with the inclined track surface and the roller surface 22*a* to urge to the supporting surface of the back plate 8, thereby preventing the coin from rising above the supporting surface of the back plate 8. Furthermore, the tapered roller can be moved through the guide slot 24 along the back plate in the direction of the width of the outlet chute passage 4** so that some variations of the diameter of coins are accepted without coin jamming.

Figure 8:
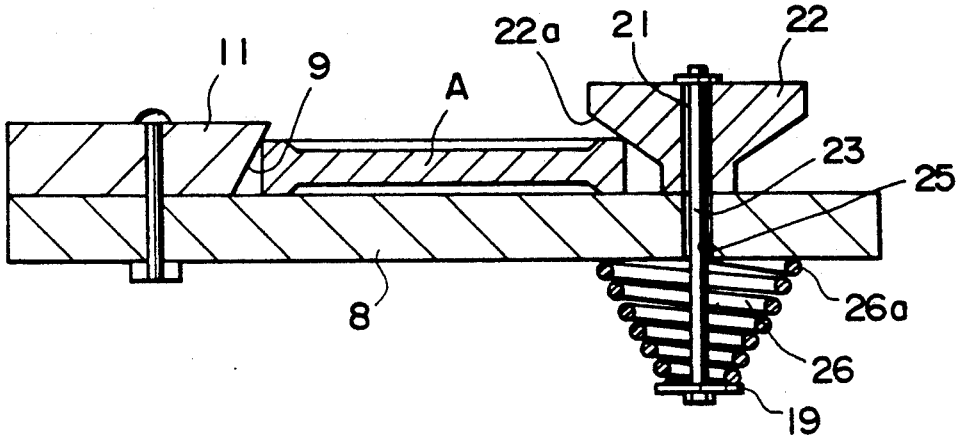
FIG. 8 is an enlarged sectional view illustrating other embodiment of urging means.

Referring to FIG. 8 illustrating another embodiment of the invention, the tapered roller 22 having the inverted conical surface **22*a* is rotatably supported on the roller shaft 23, but the roller shaft 23 is extended through a hole 25 formed in the back plate 8. A spiral spring 26 is interposed between the rear surface of the back plate 8 and a spring seat 19 secured to the extended end of the roller shaft 23 with the large diameter end 26*a* of the spiral spring 26** being engaged with the rear surface of the back plate.

With such an arrangement, a coin A entered between the outside edge plate 11 and the tapered roller 22, as shown in FIG. 8, is urged to the supporting surface of the back plate 8 by the inclined surface of the outside coin guide track 9 and the tapered roller surface **22*a*, thereby preventing the normal coin from rising above the supporting surface of the back plate 8** in the same manner as mentioned above.

In the embodiment shown in the drawings, a tapered roller is used, but a plurality of tapered roller may be used, if necessary. Furthermore, the tapered roller may be used in place of the outside coin guide track to provide a pair of left and right tapered rollers.

What is claimed is:

1. An outlet device for a coin payout hopper including an outlet chute comprising a curved outlet chute passage having a lower inlet through which coins are pushed into the passage substantially in the horizontal direction and an upper outlet through which coins are pushed out the passage substantially in the vertical direction, an outside edge plate having an outside coin guide track positioned at the outside with respect to the center of the radius of curvature of the curved outlet chute passage and being fixed to a coin supporting back plate such that the outside coin guide track is inclined at an angle to the surface of the coin supporting back plate, an inside edge plate having an inside coin guide track positioned at the inside with respect to the center of the radius of curvature of the curved outlet chute passage and being covered at the lower inlet portion thereof with a flexible front plate such that a portion of the flexible front plate is extended beyond the inside coin guide track to engage outer peripheral portions of coins, at least one rotatable tapered guide roller having an inverted conical surface arranged at the upper outlet portion adjacent to the inside edge plate, and means for urging the tapered roller to engage the inverted conical surface with the outer periphery of the coin, thereby urging the coin to the surface of the coin supporting back plate.

2. The outlet device as claimed in claim 1, wherein the flexible front plate is made of urethane rubber having a hardness in a range of 60°-70°.

3. The outlet device as claimed in claim 1, wherein the outer coin guide track is inclined at an acute angle $\theta$ to the coin supporting surface of the coin supporting back plate.

4. The outlet device as claimed in claim 1, wherein the tapered guide roller is rotatably supported on a roller shaft which is substantially perpendicularly extended through a guide slot formed in the back plate, and a slide shoe is secured to the extended end of the roller shaft and is drawn toward the outside edge plate by means of a tension spring.

5. The outlet device as claimed in claim 1, wherein the tapered guide roller is rotatably supported on a roller shaft which is substantially perpendicularly extended through a through hole formed in the back plate and a spiral spring is interposed between the rear surface of the back plate and a spring seat secured to the extended end of the roller shaft.

* * * * *